US008118613B2

(12) United States Patent
Rapp et al.

(10) Patent No.: US 8,118,613 B2
(45) Date of Patent: Feb. 21, 2012

(54) APPARATUS TO CONNECT A SHIELDED LINE TO A HOUSING USING A CRIMP SLEEVE WITH A SEALING PROJECTION WITH A METAL SEAL

(75) Inventors: Tilmann Rapp, Crailsheim (DE); Herbert Heidler, Ilshofen (DE); Hans-Joachim Haas, Elpersheim (DE)

(73) Assignee: Huber+Suhner AG, Herisau (CH)

( * ) Notice: Subject to any disclaimer, the term of this patent is extended or adjusted under 35 U.S.C. 154(b) by 0 days.

(21) Appl. No.: 12/968,462

(22) Filed: Dec. 15, 2010

(65) Prior Publication Data

US 2011/0143589 A1 Jun. 16, 2011

(30) Foreign Application Priority Data

Dec. 16, 2009 (DE) ..... 20 2009 016 970 U

(51) Int. Cl.
*H01R 9/05* (2006.01)

(52) U.S. Cl. ..... 439/585

(58) Field of Classification Search ..... 439/578–585, 439/607.5

See application file for complete search history.

(56) References Cited

U.S. PATENT DOCUMENTS

| | | | | |
|---|---|---|---|---|
| 6,261,108 | B1 * | 7/2001 | Kanagawa et al. | 439/98 |
| 6,280,208 | B1 | 8/2001 | Masuda et al. | |
| 6,524,121 | B2 * | 2/2003 | Kanagawa | 439/98 |
| 6,688,896 | B2 | 2/2004 | Matsumoto | |
| 6,793,532 | B2 | 9/2004 | Saito et al. | |
| 7,632,144 | B2 * | 12/2009 | Sakaguchi et al. | 439/585 |
| 2007/0249225 | A1 * | 10/2007 | Sakaguchi et al. | 439/578 |
| 2009/0133925 | A1 | 5/2009 | Albert et al. | |

FOREIGN PATENT DOCUMENTS

| | | | |
|---|---|---|---|
| DE | 10016943 | A1 | 10/2000 |
| DE | 10222820 | A1 | 12/2002 |
| DE | 102007051836 | A1 | 5/2009 |
| EP | 1045476 | A2 | 10/2000 |

* cited by examiner

*Primary Examiner* — Chandrika Prasad

(74) *Attorney, Agent, or Firm* — Bill C. Panagos; Rader, Fishman & Grauer PLLC

(57) ABSTRACT

With a connecting apparatus for connecting a shielded line with a housing the line can be electrically contacted in the housing interior. The connecting apparatus comprises at least one crimp sleeve through the sleeve hollow of which at least one conductor of the line is guidably arrangeable up into the housing interior. A conductor shielding of the line can be fixed at a free end section by means of crimping relative to the crimp sleeve and is in a shielded contact with the housing. According to the invention the corresponding conductor shielding is connected with the housing in an easy manner so as to achieve a corresponding shielded contact between the housing and the conductor shielding. The conductor shielding and the housing as a whole may hence be regarded as a shielding. A good electrical and electronic freedom from interference is obtained for corresponding devices inside the housing as well as for the corresponding connecting apparatus with respect to the environment, see EMC.

16 Claims, 2 Drawing Sheets

APPARATUS TO CONNECT A SHIELDED LINE TO A HOUSING USING A CRIMP SLEEVE WITH A SEALING PROJECTION WITH A METAL SEAL

CROSS REFERENCE TO RELATED APPLICATIONS

This application claims priority based on German Patent Application 20 2009 016 970.7 filed Dec. 16, 2009, which is hereby incorporated by reference in its entirety.

BACKGROUND

The invention relates to a connecting apparatus for connecting a shielded line with a housing. The line can be electrically contacted in the housing interior. The connecting apparatus comprises at least one crimp sleeve through the sleeve hollow of which at least one conductor of the line is guidably arrangeable up into the housing interior. A free end section of a conductor shielding can be folded over a sleeve shell of the sleeve and can be fixed by means of crimping relative to the crimp sleeve and is in shielded contact with the housing.

As a rule, such a shielded conductor comprises a number of separately insulated lines. These lines are arranged in the conductor and are surrounded by a conductor shielding and, if necessary, by another outer shell. Such shielded conductors serve the transmission of signals or the like, which are picked off and processed further inside the housing.

SUMMARY

According to the invention the corresponding conductor shielding is connected with the housing in an easy manner so as to achieve a corresponding shielded contact between the housing and the conductor shielding. The conductor shielding and the housing as a whole may hence be regarded as a shielding. Consequently, a good electrical and electronic freedom from interference is obtained for corresponding devices inside the housing as well as for the corresponding connecting apparatus with respect to the environment, see EMC. Furthermore, the specific connecting apparatus according to the invention provides for a good media resistance, that is, resistance of the connection produced by the connecting apparatus to, for instance, humidity, temperature influence or the like.

According to the invention the conductor shielding extends through the crimp sleeve at least until it is close to the housing. In this section the conductor shielding is separated from the conductor(s) and is folded over the sleeve shell. In the free end section of the conductor shielding the same is then fixed by means of crimping, i.e. by a corresponding mechanical connection relative to the crimp sleeve and is in shielded contact with the housing by this end section.

To permit a close arrangement of the crimp sleeve, for instance, in a corresponding opening of the housing, the crimp sleeve may be provided with a sealing projection which projects radially in an outward direction.

According to the invention the shielding contact of the connecting apparatus and the housing is accomplished by a corresponding contact of a part of the connecting apparatus with the housing. In this connection it may be an advantage if a corresponding shield conduction from the conductor shielding to the housing is achieved by means of the crimp sleeve and the fixing attachment and/or the insertion part.

As a rule, such a crimp connection serves the connection of corresponding components with each other by plastic deformation. Crimp connections are known per se.

In this context it should also be borne in mind that a possibly existing outer shell can be arranged in the crimp sleeve in a corresponding manner and has to be removed substantially only in the free end section of the conductor shielding prior to the crimping.

It is also possible, however, that the conductor shielding is freed from the outer shell in the entire linear section that is arranged in the crimp sleeve.

In order to hold the outer shell at least over a part of the length of the crimp sleeve, the crimp sleeve may be crimped onto the outer shell.

To permit an easy and reliable production of the crimp connection it is possible that the free end section of the shielding, which is folded over a crimp section of the outer sleeve, is fixed by means of a shield crimp sleeve. In this way the conductor shielding is led close to the housing and, after having been folded over, fixed by the shield crimp sleeve and by the crimp sleeve.

Folding over the corresponding end section results in a more reliable connection and a greater possible tensile stress.

The shield crimp sleeve may have different dimensions, whereby it may be favorable if it extends substantially between the sealing projection and a housing end of the crimp sleeve facing the housing. This allows a crimping in the entire area between the housing end and the sealing projection in order to fix the conductor shielding. Moreover, these dimensions of the shield crimp sleeve also allow a sufficient and intimate contact with the conductor shielding, which has a positive influence on a corresponding shielding contact and crimp conduction to the housing, respectively.

In order to be able to fix the connecting apparatus to the housing in a simplified and reliable manner the connecting apparatus may be provided with a fixing attachment which has at least one sleeve opening. The crimp sleeve can be passed through the sleeve opening and fixed to the housing by means of the fixing attachment.

According to a simple embodiment of such a fixing attachment the fixing attachment is provided with a substantially plate-shaped fixing part including a sealing edge which projects from a backside of the plate facing the housing in the direction towards a housing opening. When the fixing part is arranged on the housing, the sealing edge is inserted into the corresponding housing opening and seals the latter against the environment. At the same time, the corresponding sealing edge also serves as an insertion aid for the fixing part. The sealing edge correspondingly surrounds the crimp sleeve, which extends into the interior of the housing.

For guiding and holding the crimp sleeve at least one receiving edge may project from a front side of the plate of the fixing part. In this connection, the corresponding sealing projection of the crimp sleeve may be in contact with the receiving edge from the direction of the backside of the plate.

Moreover, it may prove to be an advantage if the sealing web is, at the same time, in a sealing contact with an inner circumference of a plate opening.

In order to be able to secure the corresponding components to each other even better and hold them relative to each other, an insertion part may be inserted into the sealing edge and fixed to the fixing attachment, particularly in a detachable manner. In other words, the insertion of the insertion part is accomplished from the direction of the housing, and if the insertion part is correspondingly fixed to the fixing attachment the crimp sleeve may be located and fixed relative to the fixing attachment at the same time.

For passing through the crimp sleeve the insertion part is provided with an opening. Moreover, this opening may have an at least partially circumferential opening edge, wherein, when the insertion part is fixed to the fixing attachment, the crimp sleeve is arranged in the opening and is surrounded by the opening edge.

To permit, in this connection, an easy holding of the crimp sleeve, the opening edge may laterally contact the sealing projection with its free end. In this way the sealing projection is held between the opening edge and the receiving edge.

The corresponding arrangement and holding of the crimp sleeve may further be simplified if the receiving edge is provided with an inwardly projecting stop with which the sealing projection is in lateral contact when the connecting apparatus is fixed to the housing.

According to a simple possibility of realizing a corresponding sealing edge, the sealing edge is provided with a sealing flange on the outer circumference of which at least one sealing element can be arranged. The sealing element may be a ring seal which may simply be pushed over the outer circumference of the sealing flange. The sealing element may extend over the total length of the sealing flange, or end spaced away from the free end of the sealing flange. The sealing element provides for a sufficient sealing between the sealing edge and the housing opening.

To permit an easy contact with the conductor(s) in the interior of the housing a conductor crimp sleeve can be placed onto an inner end of the conductor associated with the housing and crimped onto the same for fixing it. The conductor crimp sleeve is, in this connection, simply placed onto the inner end and then correspondingly mechanically deformed.

A corresponding electrical contacting of the conductor crimp sleeve may be accomplished in different ways. A simple and reliable electrical connection can be achieved if the conductor crimp sleeve is provided with a specifically pin-shaped connecting device at its connection end facing away from the crimp sleeve. Thus, housing contact devices can be connected by screwing or the like, which then correspondingly produce the electrical contact with the conductor.

Corresponding conductor crimp sleeves and contact devices are usable for each conductor of the line.

When the conductor crimp sleeve is placed onto the inner end of the conductor the sleeve may comprise a substantially circumferential insertion edge which represents the stop.

An advantageous embodiment of the invention will be described in more detail below by means of the figures shown in the drawing.

DETAILED DESCRIPTION

Figure 1:
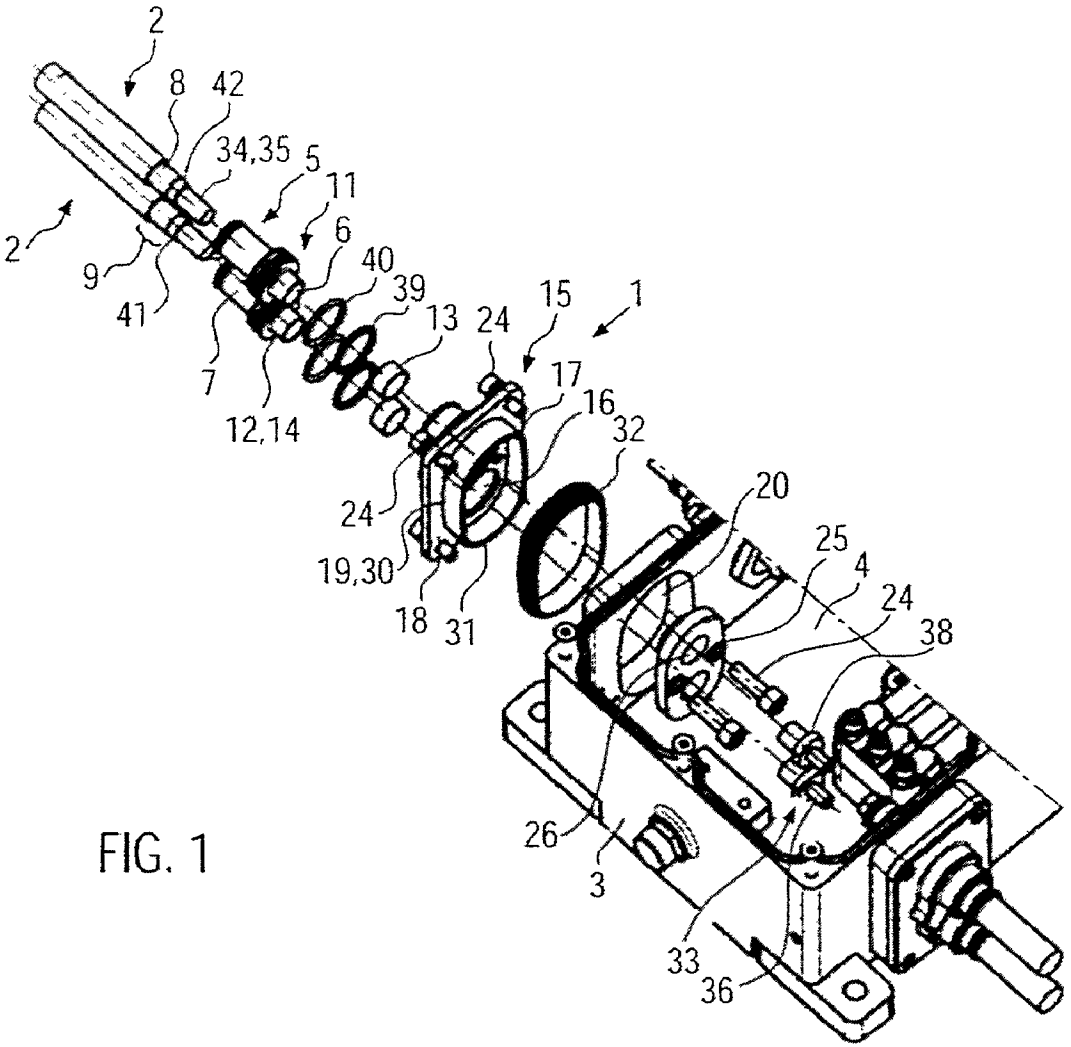
FIG. 1 shows a perspective exploded view of an inventive connecting apparatus with a partially illustrated housing in a first view.

FIG. 1 shows a perspective exploded view of the inventive connecting apparatus 1. This apparatus serves to fix a line 2 to a housing 3. The conductor 2 is passed into a housing interior 4 by means of a crimp sleeve 5. In the housing interior 4 the conductor is electrically contacted and serves, for instance, the transmission of signals to devices for the further processing thereof arranged in the housing 3.

The line 2 comprises at least one conductor 35, a conductor insulation 42 and a conductor shielding 8. In addition to the conductor shielding 8 an outer shell may furthermore be provided on the outside of the conductor shielding.

The conductor 35 and the conductor insulation 42 are passed through a corresponding sleeve hollow 6 of the crimp sleeve 5 into the housing interior 4. On an approximately central section the crimp sleeve 5 comprises a radially outwardly projecting and circumferential sealing projection 11. On its outer circumference the sealing projection 11 is provided with corresponding sealing elements 39, 40, for instance, in form of one or more O-rings 40 and a metal seal 39. The crimp sleeve 5 is provided with a crimp section 12 at its housing end 14 facing the housing 3. This crimp section 12 has a smaller diameter as compared to the rest of the crimp sleeve 5 so that a shield crimp sleeve 13 can be arranged in the crimp section 12, the outer circumference of which substantially corresponds to the rest of the crimp sleeve 5.

A certain free space is formed between the crimp section 12 and the shield crimp sleeve 13.

The conductor shielding 8 comprises an end section 9 which can be folded over a sleeve shell 7 in the direction of the crimp section 12 and which can be arranged in the corresponding free space between the crimp section 12 and the shield crimp sleeve 13.

By mechanically deforming the shield crimp sleeve 13 the corresponding end section 9 can then be fixed mechanically. Moreover, a corresponding deformation of the crimp sleeve 5 also relative to the outer shell of the line can be achieved by a corresponding deformation (crimping), by means of which the line is fixed in the crimp sleeve.

Figure 2:
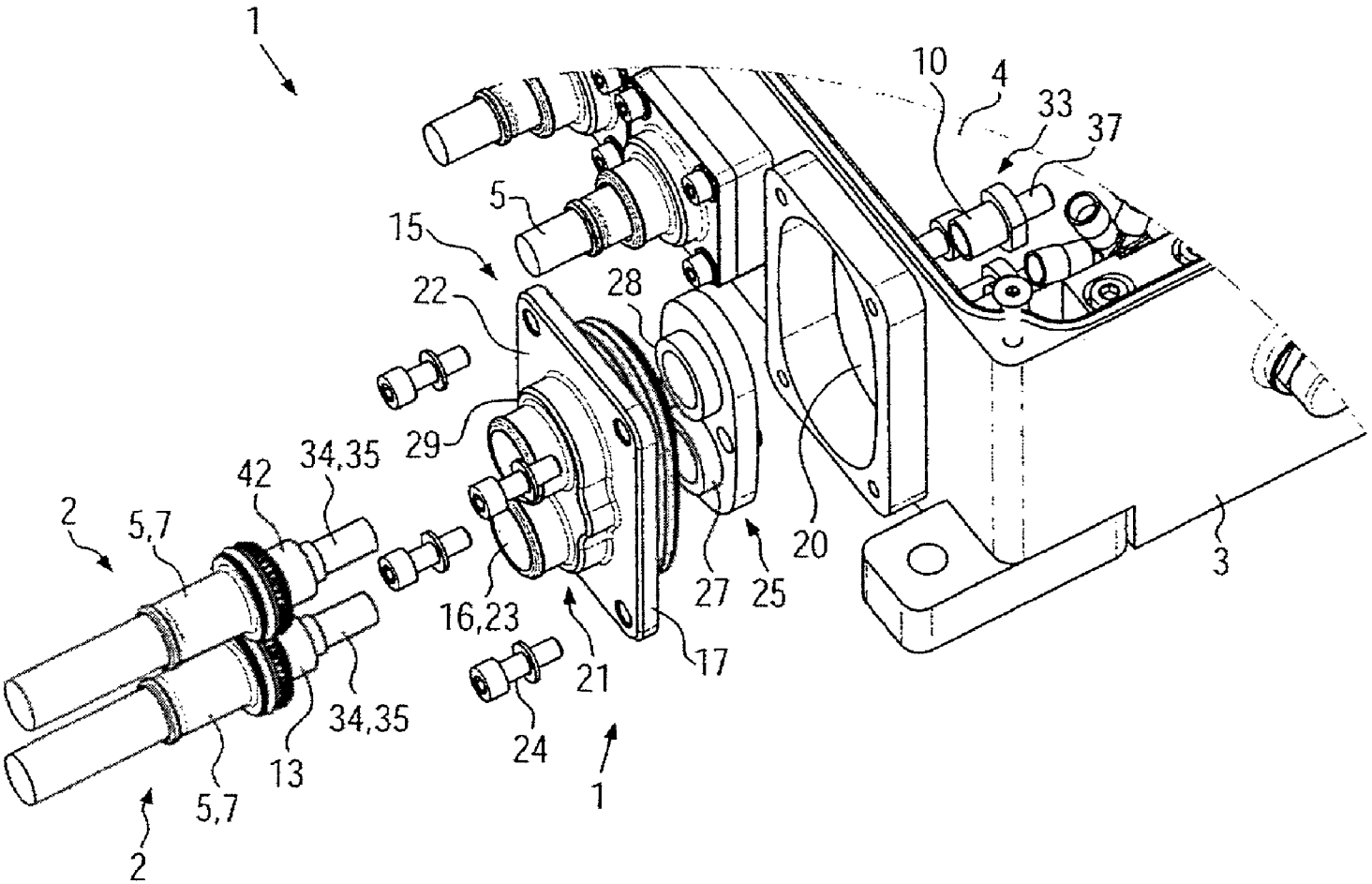
FIG. 2 shows the connecting apparatus of FIG. 1 in another view.

Not illustrated in FIGS. 1 and 2 is a diameter reduction of the crimp sleeve 5 adjacent to the sealing projection 11 as junction to the crimp section 12. This diameter reduction brings about a special adaptation to the line, without an outer shell in this area.

A fixing attachment 15 serves to fix the crimp sleeve 5 to the housing 3. This attachment comprises at least one sleeve opening 16 in which the crimp sleeve 5 can be arranged.

The fixing attachment 15 further comprises a substantially plate-shaped fixing part 17, which is rectangular and includes bores in corresponding corners for fixing the fixing attachment 15 to an outer side of the housing 3 by means of a number of fixing screws 24. A sealing edge 19 projects from a backside of the plate 18 of the fixing part 17, which backside of the plate 18 faces the housing 3, in the direction of a housing opening 20 of the housing 3, also see FIG. 2. The sealing edge 19 can be inserted into the housing opening 20. After this insertion the fixing attachment is fixed by means of the fixing screws 24. The sealing edge 19 comprises a sealing flange 30 which projects in the direction of the housing opening 20, see FIG. 1, on the outer circumference 31 of which a sealing element 32 is arranged, for instance in form of a silicone seal. This sealing element 32 serves to seal the fixing attachment 15 inside the housing opening 20.

The sealing edge 19 further serves the arrangement of an insertion part 25, which has an analogous shape and can be detachably fixed by means of additional fixing screws 24 inside the sealing edge 19 to the backside of the plate 18 of the fixing attachment 15.

A receiving edge 21 projects from the front side of the plate 22, which is opposite the backside of the plate 18, in the direction of the crimp sleeve 5. This receiving edge 21 comprises an inwardly projecting stop 29 with which the sealing projection 11 is in contact when the crimp sleeve 5 is arranged in the sleeve opening 16. In this connection, the crimp sleeve 5 and the sealing projection 11 are, at the same time, sealed by a corresponding inner circumference 23 of the sleeve opening 16. In this corresponding position of the crimp sleeve 5 relative to the fixing attachment 15 the insertion part 25 presses the sealing projection 11 into the corresponding contact with the stop 29. To this end, the insertion part 25 is provided with an opening edge 27 which surrounds an opening 26, whose free end 28 relative to the side of the housing opening 20 is laterally adjacent to the sealing projection 11.

In the fixed position of the insertion part 25 the shield crimp sleeve 13 as well as the crimp section 12 of the crimp sleeve 5 are arranged inside the opening 26, also see FIG. 2.

If the crimp sleeve 5 is fixed to the housing 3 by means of the fixing attachment 15 an inner end 34 of the conductor 35 extends into the housing interior 4. A conductor crimp sleeve 33 can be placed onto this inner end 34 where it can be fixed by means of deformation. The conductor crimp sleeve 33 further comprises a circumferential insertion edge 38 from which a substantially pin-shaped connection end is projecting. This serves the electrical contacting of the conductor 33 and thus the electrical connection to devices arranged in the housing 3, for instance, by screwing or the like.

Apart from the connecting apparatus 1 shown in an exploded view, FIGS. 1 and 2 illustrate additional connecting apparatus 1 which are already mounted on the housing 3. These comprise only one crimp sleeve 5, while the other connecting apparatus 1 has two crimp sleeves 5 with corresponding additional devices arranged on top of each other, which are fixed to the housing by means of a fixing attachment 15.

In the additional connecting apparatus 1 according to FIGS. 1 and 2 corresponding fixing attachments 15 and insertion parts 25 each have only one opening, see sleeve opening 16 and opening 26, respectively.

Apart from that, the rest of the statements with regard to the connecting apparatus also apply to the other connecting apparatus according to FIGS. 1 and 2.

FIG. 2 illustrates another perspective view of the connecting apparatus 1 according to FIG. 1. The shield crimp sleeve 13 is pushed onto the crimp sleeve 5, whereby the corresponding free space for inserting the folded over end section 9 of the conductor shielding 8 is formed between them, where the end section 9 is crimped.

In other respects, reference is made to the statement relating to FIG. 1.

The connecting apparatus according to the invention provides for an easy and reliable transfer of the shielding of the line by the conductor shielding to the corresponding housing 3. This transfer is particularly achieved by shield conduction to the housing by the shield crimp sleeve and the crimp sleeve with a metal seal and the fixing attachment and/or the insertion part. Thus, the housing as well as the connecting apparatus according to the invention are media-resistant and fulfill corresponding requirements with respect to electromagnetic compatibility (EMC).

According to the invention this is particularly achieved by means of the inventive connecting apparatus which allows the shield conduction of the conductor shielding to the housing in an easy and reliable manner.

The invention claimed is:

1. A connecting apparatus for connecting a shielded line with a housing having an interior, which line can be electrically contacted in the housing interior, wherein the connecting apparatus comprises at least one crimp sleeve through a sleeve hollow of which at least one conductor of the line is guidably arrangeable up into the housing interior, wherein a conductor shielding of the line can be fixed at a free end section by means of crimping relative to the crimp sleeve and is in a shielded contact with the housing, said crimp sleeve is provided with a sealing projection which projects radially in an outward direction, on which sealing projection at least one circumferential metal seal is arranged and a shield conduction from the conductor shielding to the housing is achieved by a shield crimp sleeve and the crimp sleeve and a fixing attachment or an insertion part.

2. The connecting apparatus according to claim 1, wherein the conductor shielding is passed through the sleeve hollow with at least one crimp section at its end.

3. The connecting apparatus according to claim 1, wherein the conductor shielding is folded with its crimp section over a crimp section of the crimp sleeve, where it is fixed by means of the shield crimp sleeve.

4. The connecting apparatus according to claim 3, wherein the shield crimp sleeve extends substantially between the sealing projection and a housing end of the crimp sleeve facing the housing.

5. The connecting apparatus according to claim 1, wherein the connecting apparatus is provided with the fixing attachment which has at least one sleeve opening through which the crimp sleeve can be passed and fixed to the housing by means of the fixing attachment.

6. The connecting apparatus according to claim 1, wherein the fixing attachment is provided with a substantially plate-shaped fixing part including a sealing edge which projects from a backside of the plate facing the housing in the direction towards a housing opening, which sealing edge is inserted into the housing opening in a sealing manner when the fixing attachment is fixed to the housing.

7. The connecting apparatus according to claim 1, wherein at least one receiving edge projects from a front side of the plate of the fixing attachment with which the sealing projection is in contact from the direction of the backside of the plate.

8. The connecting apparatus according to claim 1, wherein the sealing projection is in a sealing contact with an inner circumference of the sleeve opening of the fixing attachment.

9. The connecting apparatus according to claim 1, wherein an insertion part is inserted into the sealing edge and fixed to the fixing attachment in a detachable manner.

10. The connecting apparatus according to claim 1, wherein the insertion part is provided with at least one opening, the opening having an edge that is at least partially circumferential, wherein the shield crimp sleeve is arranged in this opening when the insertion part is fixed to the fixing attachment.

11. The connecting apparatus according to claim 10, wherein the opening edge has its free end adjacent to the sealing projection.

12. The connecting apparatus according to claim 1, wherein the receiving edge is provided with an inwardly projecting stop with which the sealing projection is in lateral contact when the connecting apparatus is fixed to the housing.

13. The connecting apparatus according to claim 1, wherein the sealing edge is provided with a sealing flange on the outer circumference of which at least one sealing element can be arranged.

14. The connecting apparatus according to claim 1, wherein a conductor crimp sleeve can be placed onto an inner end of the conductor associated with the housing and crimped onto the same for fixing it.

15. The connecting apparatus according to claim 1, wherein the conductor crimp sleeve is substantially pin-shaped at its connection end facing away from the crimp sleeve.

16. The connecting apparatus according to claim 1, wherein the connection end is provided with a substantially circumferential insertion edge.

* * * * *